United States Patent [19]

Washington

[11] Patent Number: 4,875,463

[45] Date of Patent: Oct. 24, 1989

[54] STOVE TOP ADAPTER

[76] Inventor: James O. Washington, P.O. Box 2926, Huntington, W. Va. 25728

[21] Appl. No.: 349,218

[22] Filed: May 9, 1989

[51] Int. Cl.[4] ..... F24C 1/14

[52] U.S. Cl. ..... 126/80; 126/307 R

[58] Field of Search ..... 126/307 R, 312, 80, 126/83, 81, 314–317, 500, 523, 531, 536, 77, 58; 98/46, 58

[56] References Cited

U.S. PATENT DOCUMENTS 4,026,264 5/1977 Henriques ..... 126/528

4,069,806 1/1978 Landry ..... 126/307 R 4,230,092 10/1980 Henriques ..... 126/529

FOREIGN PATENT DOCUMENTS 750582 8/1933 France ..... 126/528

*Primary Examiner*—James C. Yeung

*Attorney, Agent, or Firm*—Sherman Levy

[57] ABSTRACT

A stove top adapter is provided which is constructed so that a collar is provided on the top side thereof whereby a pipe can be received to be vented through a full masonry chimney in order to achieve a direct connection of pipe from the stove through the chimney to the cap on top of the chimney.

4 Claims, 1 Drawing Sheet

STOVE TOP ADAPTER

BACKGROUND OF THE INVENTION

The present invention generally appertains to improvements in stoves, and more particularly to adapters for wood burning stoves or stoves that burn other fuels wherein the adapter is constructed to receive a pipe or duct to be vented through a full masonry chimney so that there can be achieved a direct connection of the pipe from the stove through a chimney into the cap on top of the chimney.

DESCRIPTION OF THE PRIOR ART

Various types of stove and flue systems are well known, as for example as shown in prior U.S. Pat. Nos. 3,664,325; 3,981,292; 4,215,814; 4,230,092; 4,257,393; 4,306,491; 4,369,761; 4,377,153; 4,553,528; and 4,688,545. However, neither these prior patents nor any others known to Applicant achieve the results accomplished by the present invention.

OBJECTS AND SUMMARY OF THE PRESENT INVENTION

A primary object of the present invention is to provide a stove top adapter which can be made of a suitable material such as stainless steel, and which may be rectangular, square, round, or oblong on the bottom side, and either round or oblong on the top side to receive either round or oblong pipe (rigid or flexible) to be vented through a full masonry chimney in order to achieve a direct connection of pipe from the stove through the chimney into the cap on top of the chimney.

Another object of the present invention is to provide a stove top adapter that will fit different types of makes of stoves such as Buck, Dove, Appalachian, Ashley, and Grizzley and in addition stoves of other manufacturers may be adapted to the stove top adapter of the present invention.

A still further object of the present invention is to provide a stove top adapter which includes a hollow member or housing that has a top opening size that varies in its dimensions, and wherein there is an opening in the bottom of the adapter for receiving exhaust from the top of the stove.

Another object of the present invention is to provide a stove top adapter that can be inexpensively manufactured and which will accomplish the desired purpose with maximum efficiency.

These and other objects of the present invention will become apparent with reference to the drawings, the Description of the Preferred Embodiment, and the appended claims.

DESCRIPTION OF THE PREFERRED EMBODIMENT

Referring in detail to the drawings, the numeral 10 indicates the stove top adapter of the present invention which consists of a hollow housing made of a suitable material such as stainless steel, and the adapter includes a pair of spaced parallel vertically disposed sidewalls 11, an inclined first top wall 12, and a collar 13 affixed to or formed integral with the first top wall 12 to extend outwardly and upwardly directly therefrom in a direction essentially normal thereto. The interior of the adapter is hollow.

Figure 1:
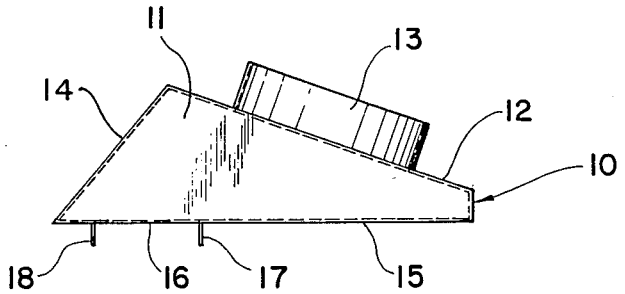
FIG. 1 is a left end elevation.
Figure 2:
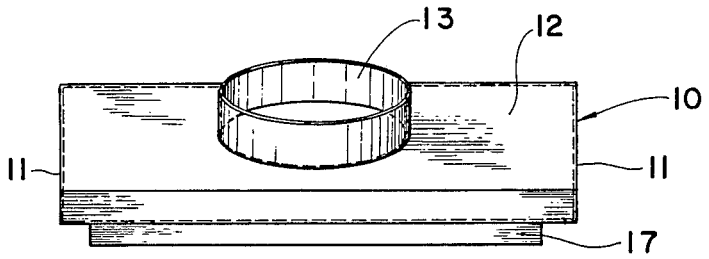
FIG. 2 is a front elevation view of the stove top adapter of the present invention.
Figure 3:
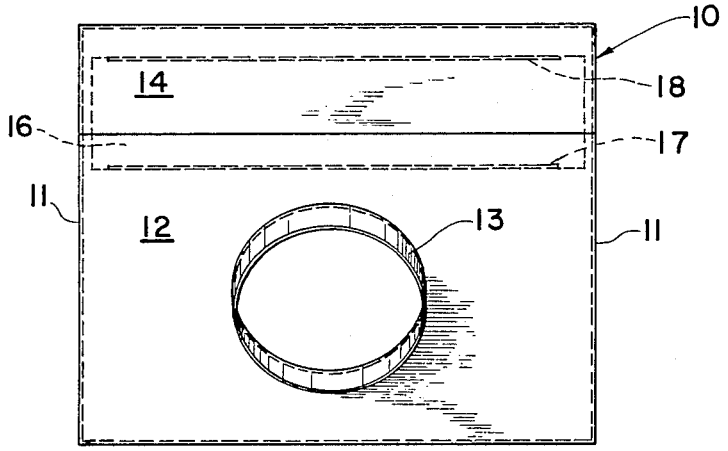
FIG. 3 is a top view of the stove top adapter.
Figure 4:
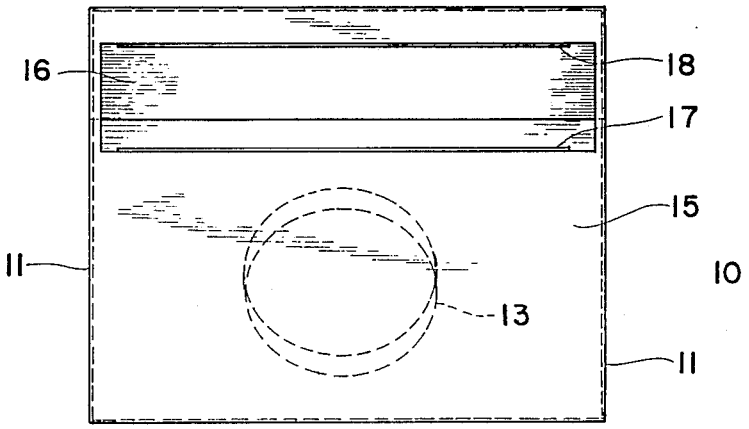
FIG. 4 is a bottom view thereof.

The adapter 10 further includes an inclined second top wall 14. There is further provided a horizontally disposed bottom wall 15 which has a rectangular opening 16 therein for receiving exhaust from the stove on which the adapter sits. Rectangular opening 16 includes a pair of opposite sides and a pair of opposite ends. A pair of spaced parallel vertically disposed flanges or ribs 17 and 18 depend from the bottom of the adapter 10 along the opposite sides only of rectangular opening 16 for helping to properly align the adapter in its proper location on top of the stove. As shown in FIG. 1, the hollow housing of adapter 10 has an outline shape of a quadrilateral configuration in cross-section.

From the foregoing it will be seen that there has been provided a stove top adapter, and in use with the parts arranged as shown in the drawings, the adapter 10 sits on top of a stove so that the opening 16 in the bottom wall 15 of the adapter registers with an opening in the top of the stove whereby the exhaust gases from the stove will enter the adapter 10 through the opening 16, and then the exhaust gases will be directed obliquely upwardly along the inner surfaces of inclined top walls 12 and 14 to escape obliquely upwardly and outwardly through the collar 13 to a pipe or duct . The latter is preferably straight, whereby the exhaust gases can be efficiently directed to a desired location, as for example through a chimney into a cap on top of the chimney.

Without the adapter, the exhaust gases from the stove would not be able to be directed in the proper direction. For example, it will be noted that the adapter 10 has the collar 13 arranged at an oblique angle because the collar 13 is affixed to the inclined top wall 12. Thus, a pipe can be connected to the collar 13 to permit such a pipe to be arranged adjacent to a brick wall and the like in a building whereby the exhaust gases can be directed or guided obliquely upwardly to the desired location without having the exhaust gases pass directly up in a vertical position. In some instances for example, it is desired to have the exhaust pipe be arranged to extend obliquely upward immediately adjacent to a brick wall rather than having the exhaust pipe for the exhaust gases discharging vertically, and due to the inclined arrangement of the collar 13, the exhaust pipe can be positioned to extend in a straight line from collar 13 adjacent to a brick wall in the most efficient manner. The depending flanges 17 and 18 provide an alignment means on both sides only of the bottom opening 16, so that the adapter can be efficiently aligned with the exhaust opening in the stove.

The top opening size varies, and for example the top opening may be 6, 7, and 8 inches in diameter, and the collar 13 may be round. Or 6, 8, or 10 inch oval collars may be used. The adapter can be made of any suitable material such as stainless steel. The parts of the adapter such as the junction between the top section 12 and the side walls 11 may be joined with lock seams.

Thus, it will be seen that there has been provided a stove top adapter which can have a rectangular, square, round, or oblong opening on its bottom wall, and a collar of round or oblong cross-section on top wall to receive a round or oblong pipe (rigid or flexible) to be vented through a full masonry chimney in order to achieve a direct connection of pipe from the stove through the chimney into the cap on top of the chimney.

The stove top adapter can be used with different types of stoves. The adapter has been described being used with wood burning stoves, but it is to be understood that the adapter can be used with other types of stoves burning different fuels beside wood.

The parts can be made of any suitable material and in different shapes and sizes.

The adapter of the present invention sits above the opening of a stove such as a wood burning stove, and the purpose of the adapter is to provide a means for communicating a round or oval pipe with the stove and to vent the stove through a chimney.

With further reference to the present invention, the top walls of the adapter are sloped for better exit of smoke and to prevent creosote build-up. The ends are Pittsburgh locked to compensate for expansion and contraction. The top collar is dove tailed, beaded, and spot welded for better attachment. A fiberglass gasket is adapted to be installed to prevent smoke leakage.

As to prior patent 3,664,325 this patent is not a sheet metal fireplace. Patent 3,981,292 is not a heater. Patent 4,215,814 is a flue gas trap and diverter and the present invention is not an energy conserving device. Patent 4,230,092 does not improve convective heating. Relative to prior patent 4,257,393, Applicant's invention is not a heat retention means. Relative to patent 4,306,491, Applicant's invention is an adapter from the stove inserter or free standing stove to the flue pipe and does not mean to eliminate the flue pipe because of the different configuration of solid fuel stoves. Round or oblong pipes may not adapt to the stove, therefore Applicant's adapter will change the shape to suit round or oblong pipes or rectangular openings. As to prior patent 4,369,761 the stove top adapter of the present invention is not a wood burning stove. Likewise as to patent 4,377,153 the present adapter is not a heating device. Referring to prior patent 4,553,528 the present invention is not a free standing stove or fireplace apparatus. As to prior patent 4,688,545 the adapter of the present invention is not a stove for burning solid fuels.

While several embodiments of the present invention have been illustrated herein in particular detail, it will be understood that variations and modifications may be effected without department from the spirit and scope of the novel concepts of this invention.

What is claimed is:

1. In a stove top adapter, a hollow member of quadrilateral configuration in cross-section having an inclined first top wall, an inclined second top wall attached at an upper end thereof to said first top wall, and an essentially horizontal bottom wall attached to said inclined second top wall at a lower end thereof, an opening in said bottom wall, said adapter being costructed and arranged to sit on top of an exhaust opening of a stove so that said opening in said bottom wall registers with said exhaust opening, and a collar extending directly from said first inclined top wall of said adapter at an essentially normal direction therefrom and constructed and arranged to extend upwardly from said first inclined top wall in a direction that is oblique to said essentially horizontal bottom wall.

2. A stove top adapter comprising a hollow housing of quadrilateral configuration in cross-section including a pair of spaced, parallel, vertically disposed sidewalls, an inclined first top wall extending obliquely upwardly and inwardly between said sidewalls, a collar fixed to said first inclined top wall and constructed and arranged to extend outwardly and upwardly directly in an essentially normal direction from said first inclined top wall, a horizontally disposed bottom wall, a second inclined top wall extending from said first inclined top wall to said horizontally disposed bottom wall, and a rectangular opening having a pair of opposite sides and a pair of opposite ends in said bottom wall, said collar being constructed and arranged to extend from said first inclined top wall in a direction that is oblique to said bottom wall.

3. The adapter as defined in claim 2 wherein said collar has a circular formation.

4. The adapter as defined in claim 3, further including vertically disposed, spaced, parallel flanges depending from said bottom wall along said opposite sides only of said rectangular opening in said bottom wall.

* * * * *